US006871619B2

(12) United States Patent
Hammer et al.

(10) Patent No.: US 6,871,619 B2
(45) Date of Patent: Mar. 29, 2005

(54) VALVE ACTUATOR FOR ACTUATING A GAS EXCHANGE VALVE OF AN INTERNAL COMBUSTION ENGINE

(75) Inventors: Uwe Hammer, Hemmingen (DE); Stefan Reimer, Markgroeningen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/840,062

(22) Filed: May 4, 2004

(65) Prior Publication Data

US 2005/0000477 A1 Jan. 6, 2005

(30) Foreign Application Priority Data

May 12, 2003 (DE) ..... 103 21 157

(51) Int. Cl.[7] ..... F01L 9/02

(52) U.S. Cl. ..... 123/90.12; 123/90.15; 123/90.24; 123/188.5; 74/579 R

(58) Field of Search ..... 123/90.12, 90.15, 123/90.24, 90.48, 90.52, 90.55, 188.2–188.5, 190.1, 190.7, 190.12; 74/579 R, 586, 593; 403/367, 368, 370, 374.3, 374.4

(56) References Cited

U.S. PATENT DOCUMENTS 5,231,959 A * 8/1993 Smietana ..... 123/90.12
6,178,935 B1 * 1/2001 Diehl et al. ..... 123/90.12
6,688,268 B2 * 2/2004 Schlembach et al. .... 123/90.48
6,729,287 B2 * 5/2004 Hammer et al. ..... 123/90.48
6,776,129 B2 * 8/2004 Diehl et al. ..... 123/90.12

FOREIGN PATENT DOCUMENTS

DE 100 40 114 2/2002
DE 101 16 218 10/2002

* cited by examiner

*Primary Examiner*—Thomas Denion
*Assistant Examiner*—Kyle M. Riddle
(74) *Attorney, Agent, or Firm*—Kenyon & Kenyon

(57) ABSTRACT

A valve actuator for actuating a gas exchange valve of an internal combustion engine, having a sleeve-shaped positioning piston, which is connected to a valve shaft, having at least two shell-shaped wedge parts, enclosing a shaft end of the valve shaft, on whose radial outer peripheral surface a section shaped like a conical casing is implemented and which are axially connected on their inner side to the shaft end in a form-locked and rotatable manner, the valve actuator having a separate threaded sleeve, which has a threaded connection to the positioning piston or a component connected to the positioning piston and also axially clamps the wedge parts to a conical clamp sleeve via their section shaped like a conical casing.

8 Claims, 2 Drawing Sheets

VALVE ACTUATOR FOR ACTUATING A GAS EXCHANGE VALVE OF AN INTERNAL COMBUSTION ENGINE

BACKGROUND INFORMATION

A valve actuator is known from German Patent Application No. DE 101 16218, in which a shaft end of a gas exchange valve is connected to the positioning piston of a valve actuator using at least two shell-shaped wedge parts, which enclose the shaft end and support themselves axially on the positioning piston, and whose radial outer peripheral surface runs conically and is enclosed by a conical clamp sleeve. The conical clamp sleeve has a radial inner peripheral surface which runs complementarily to the conical angle of the wedge parts and is axially clamped against them by a threaded connection implemented on the wedge parts. Because of the implementation of the conical angle and threaded connection on the wedge parts, these are relatively complex components which are very costly to manufacture.

A connection between a shaft end of a gas exchange valve of an internal combustion engine and a final controlling element of a valve actuator, in which the wedge parts are clamped using a separate conical clamp sleeve, is known from German Patent Application No. DE 100 40 114. The clamping is performed via a clamping body and an interposed clamping disk. The connection occurs at the end of the final controlling element distal from the combustion chamber and therefore requires a relatively long shaft. In addition, a relatively high part count is necessary for this clamped connection.

SUMMARY OF THE INVENTION

According to the present invention, provided for the connection of the gas exchange valve to the valve actuator is a separate threaded sleeve, which has a threaded connection to the positioning piston or a component connected to the positioning piston and also axially clamps the wedge parts to the positioning piston or the component connected thereto via their section shaped like a conical casing. Through the threaded sleeve, which is implemented like a union nut, a simple connection of the gas exchange valve and the valve actuator may be created with a low piece count, which results in a low manufacturing and assembly outlay.

It is especially advantageous to implement the conical clamp sleeve in one piece on the threaded sleeve.

In addition, for the desired piece count reduction, it may be advisable to screw the threaded sleeve directly onto the positioning piston.

DETAILED DESCRIOTION

In the following description of the exemplary embodiments, identical and identically acting parts are identified by identical reference-numbers.

Figure 1:
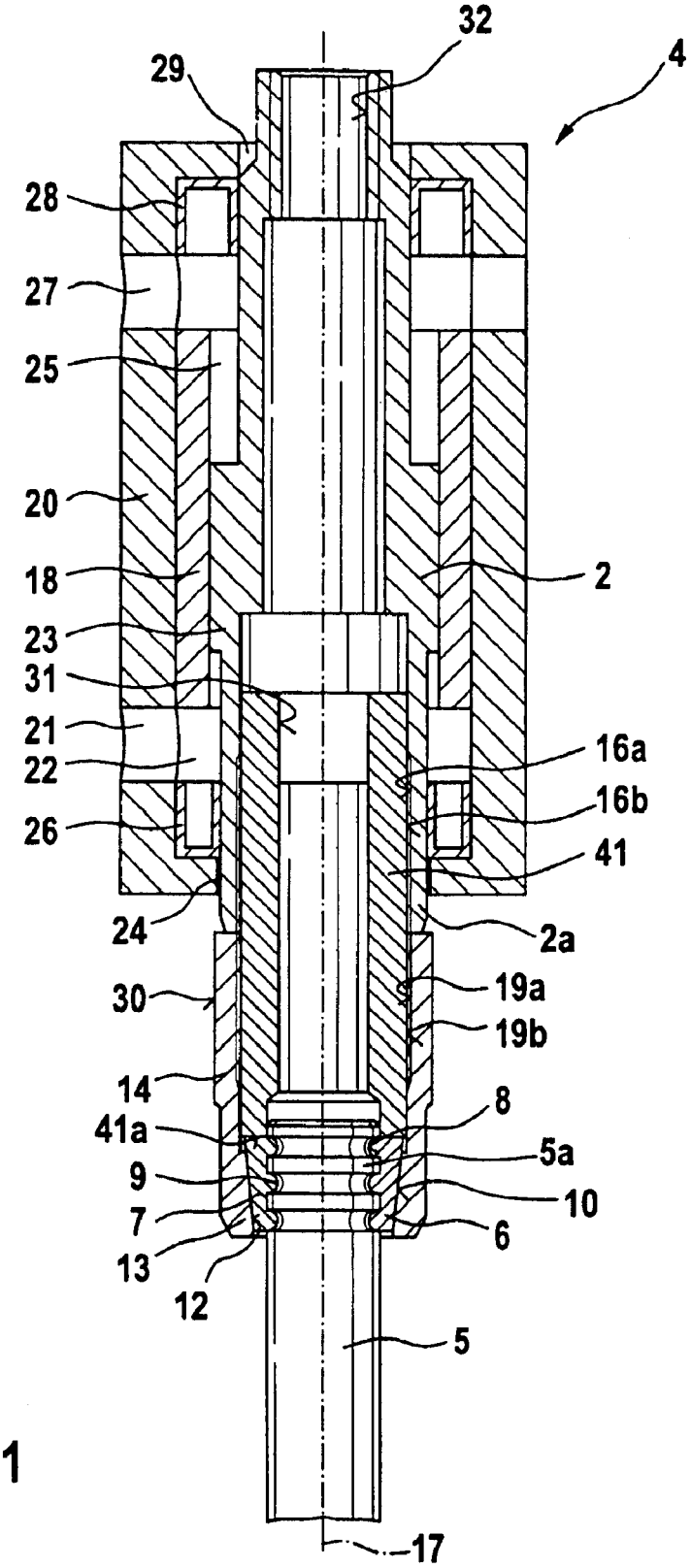
FIG. 1 shows a longitudinal sectional illustration of a first exemplary embodiment of a valve actuator according to the present invention.

A valve shaft 5 of a valve gear of an internal combustion engine, which is connected in a known way to a valve disk (not shown in greater detail) of a gas exchange valve, is shown in FIG. 1. Valve shaft 5 is connected to a hollow-cylindrical positioning piston 2 of a valve actuator 4, via which valve shaft 5 is actuated in such a way that it executes up and down opening and closing motions in the axial direction.

Valve shaft 5 extends away from the combustion chamber (not shown) of the internal combustion engine in the axial direction and has a shaft end 5*a*, distal from the combustion chamber, which is enclosed by two wedge parts 6, 7 shaped like half shells. Shaft end 5*a* has at least one groove 8 in this case, in which at least one bead 9 implemented on the inner circumference of wedge parts 6, 7 engages radially. In the example, a total of three annular grooves 8 are provided positioned axially equidistant on valve shaft 5 and three corresponding annular beads 9 are provided on wedge parts 6, 7. Annular beads 9 are formed in this case by essentially semicircular partial beads on both wedge parts 6, 7, which combine in a circular shape into annular beads 9.

Wedge parts 6, 7 form a section 10 shaped like a conical casing on their outer peripheral surface, whose diameter becomes greater with increasing distance from the combustion chamber. Both wedge parts 6, 7 form a clamping wedge 11 together, which works together with a corresponding conical inner surface 12 of a conical clamp sleeve 13. Conical clamp sleeve 13 is implemented in one piece on a hollow-cylindrical threaded sleeve 14, which concentrically encloses shaft end 5a and wedge parts 6, 7.

Positioning piston 2 extends in the axial direction along an axis 15 concentric to a longitudinal axis 17 of valve shaft 5. Valve actuator 4 has an actuator housing 20, which is penetrated axially by positioning piston 2. A guide sleeve 18, inside which positioning piston 2 is movably guided axially via a guide collar 23 on positioning piston 2, is located in actuator housing 20. In actuator housing 20, a first chamber 22, which is connected through a first opening 21 in the wall of actuator housing 20 to a first pressure means line (not shown in greater detail), is formed on the side of guide collar 23 facing toward the combustion chamber. In this case, first chamber 22 is delimited by actuator housing 20, guide sleeve 18, and positioning piston 2, including guide collar 23. A first sealing ring 26 prevents the pressure means located in first chamber 22, hydraulic fluid, for example, from exiting actuator housing 20 via a first annular gap 24.

In actuator housing 20, a second chamber 25, which is connected through a second opening 27 in the wall of actuator housing 20 to a second pressure means line (also not shown in greater detail), is formed on the side of guide collar 23 facing away from the combustion chamber. Second chamber 25 is also delimited in this case by actuator housing 20, guide sleeve 18, and positioning piston 2, including guide collar 23. A second sealing ring 28 prevents the pressure means located in second chamber 25 from exiting actuator housing 20 via a second annular gap 29.

A threaded bolt 41, which is secured in positioning piston 2 via a threaded connection 16*a*, 16*b*, is introduced concentrically in an end 2*a* of positioning piston 2 proximal to the combustion chamber. Threaded connection 16*a*, 16*b* includes a thread 16*a* on positioning piston 2 and a corresponding thread 16*b* on threaded bolt 41.

Threaded bolt 41 carries an external thread 19*b*, via which threaded bolt 41 is connected to an internal thread 19*a* on threaded sleeve 14. Threaded connections 16*a*, 16*b*; 19*a*, 19*b* may be implemented in the same direction or even in opposite directions. Implementation of threads 16*a*, 16*b*; 19*a*, 19*b* in opposite directions has the advantage that threaded sleeve 14, threaded bolt 41, and positioning piston 2 may be screwed together securely because of the self-locking effect that then results, without it being necessary to secure threaded connections 16*a*, 16*b*; 19*a*, 19*b*.

Threaded bolt 41 has a front face 41*a*, proximal to the combustion chamber, which presses against wedge parts 6, 7 and clamps them axially to conical inner surface 12 of conical clamp sleeve 13 via their outer side 10, which is shaped like a conical casing. Bowl faces 30, 31, 32 for applying tools for tightening threaded connections 16*a*, 16*b*, 19*a*, 19*b* are located on threaded sleeve 14, threaded bolt 41, and positioning piston 2.

Figure 2:
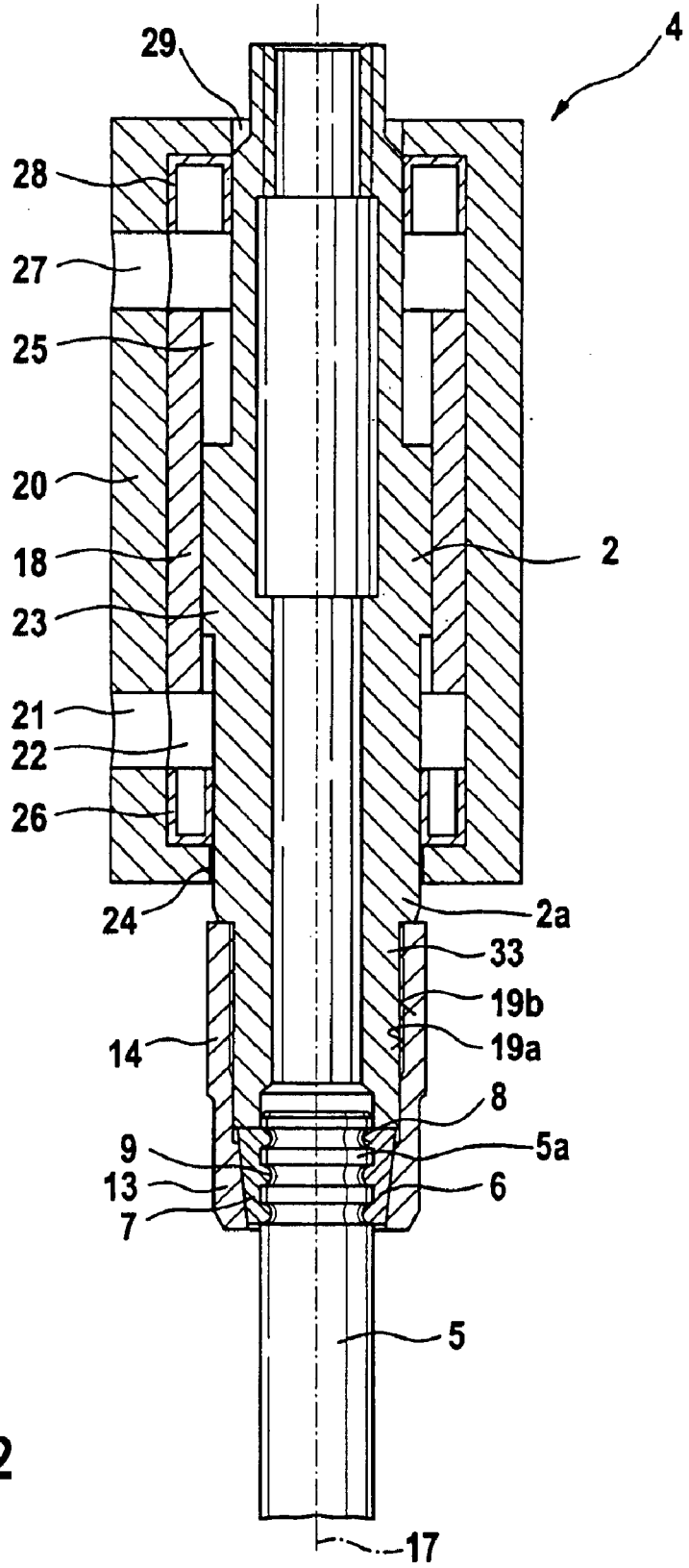
FIG. 2 shows a longitudinal sectional illustration of a second exemplary embodiment of a valve actuator according to the present invention.

A second exemplary embodiment of the present invention is shown in FIG. 2, in which threaded sleeve 14 is screwed directly onto a projection 33 of positioning piston 2, proximal to the combustion chamber, via threaded connection 19*a*, 19*b*. The function of threaded bolt 41 from FIG. 1 is therefore assumed directly in the exemplary embodiment according to FIG. 2 by hollow-cylindrical projection 33, which is implemented in one piece on positioning piston 2.

Against this backdrop, the function of valve actuator 4 may be illustrated as follows:

In FIG. 1, valve shaft 5 is shown in an open position, in which both chambers 22, 25 have pressure applied to them via the pressure means lines. Because of the smaller axial piston area of positioning piston 2 on first chamber 22, positioning piston 2 is shifted axially toward the combustion chamber. To close gas exchange valve 1, second chamber 25 is depressurized, while first chamber 22 always has pressure applied to it. Because of the excess pressure in first chamber 22, positioning piston 2 is then shifted upward in the direction toward second chamber 25.

For installation of valve actuator 4, valve shaft 5 is inserted into the valve shaft guide of the cylinder head (not shown) and threaded sleeve 14 is pushed over shaft end 5*a* of valve shaft 5. Subsequently, wedge parts 6, 7 are placed on shaft end 5*a* in such a way that annular beads 9 engage in annular grooves 8. The diameter of wedge parts 6, 7 is designed in such a way that the front faces of the two wedges touch and some play with respect to valve shaft 5 results. This compensates for tolerances and concentricity errors.

Next, threaded bolt 41 is screwed into threaded sleeve 14 until front face 41*a* presses against wedge parts 6, 7 and clamps them to threaded sleeve 14. As the next work step, actuator housing 20 and positioning piston 2 of valve actuator 4 are then installed. Finally, threaded bolt 41 is screwed into the inside of positioning piston 2.

In the exemplary embodiment shown in FIG. 2, the last work step of screwing the threaded bolt into positioning piston 2 is dispensed with. Rather, threaded sleeve 14 may be screwed directly onto end 2*a* of positioning piston 2.

The applicability of the present invention is not restricted to the exemplary embodiments described above. Thus, numerous possible changes in the concrete embodiment are conceivable, which do not significantly change the conceptual content of the present invention. Thus, for example, positioning piston 2 may be housed more or less completely in actuator housing 20. The number of annular grooves 9 and annular beads 8 may vary. The grooves and/or beads may also each be implemented on the other component without changing the mode of operation of the valve actuator. The lugs for screwdrivers and wrenches may be positioned differently from the embodiment described.

What is claimed is:

1. A valve actuator for actuating a gas exchange valve of an internal combustion engine, comprising:

a valve shaft having a shaft end;

a sleeve-shaped positioning piston connected to the valve shaft;

at least two shell-shaped wedge parts enclosing the shaft end of the valve shaft, the wedge parts being axially connected on their inner side to the shaft end in a form-locked and rotatable manner;

a section shaped like a conical casing situated on a radial outer peripheral surface of the wedge parts;

a conical clamp sleeve; and a separate threaded sleeve having one of (a) a threaded connection to the positioning piston and (b) a component connected to the positioning piston, the threaded sleeve axially clamping the wedge parts to the conical clamp sleeve via the section shaped like a conical casing.

2. The valve actuator according to claim 1, wherein the conical clamp sleeve is implemented in one piece on the threaded sleeve.

3. The valve actuator according to claim 2, wherein the threaded sleeve has an internal thread which is connected to one of (a) an external thread on the positioning piston and (b) the component connected to the positioning piston.

4. The valve actuator according to claim 1, further comprising a threaded bolt screwing together the threaded sleeve with the positioning piston.

5. The valve actuator according to claim 1, wherein the threaded sleeve is screwed directly onto a projection of the positioning piston proximal to a combustion chamber of the engine.

6. The valve actuator according to claim 1, wherein the wedge parts and the valve shaft are connected to one another rotatably and axially in a form-locked manner via at least one radial groove and at least one radial bead, which engages therein.

7. The valve actuator according to claim 6, wherein the at least one groove is situated on the valve shaft and the at least one bead is situated on the wedge parts.

8. The valve actuator according to claim 7, wherein the at least one groove includes three peripheral grooves situated on a threaded bolt, the at least one bead includes three corresponding beads, and each of the three corresponding beads engages in the peripheral grooves.

* * * * *